United States Patent [19]

Daniels

[11] Patent Number: 4,728,865

[45] Date of Patent: Mar. 1, 1988

[54] ADAPTION CIRCUIT FOR OPERATING A HIGH-PRESSURE DISCHARGE LAMP

[75] Inventor: Johny A. J. Daniels, Turnhout, Belgium

[73] Assignee: U.S. Philips Corporation, New York, N.Y.

[21] Appl. No.: 846,653

[22] Filed: Mar. 31, 1986

[30] Foreign Application Priority Data

Apr. 9, 1985 [NL] Netherlands ..... 8501025

[51] Int. Cl.[4] ..... H05B 37/02

[52] U.S. Cl. ..... 315/194; 315/199; 315/200 R; 315/208; 315/224; 315/289; 315/DIG. 7

[58] Field of Search ..... 315/DIG. 4, 200 R, 208, 315/194, 199, 224, 289, DIG. 7

[56] References Cited

U.S. PATENT DOCUMENTS

| | | | |
|---|---|---|---|
| 3,361,931 | 1/1968 | Vollrath | 315/DIG. 4 |
| 3,500,124 | 3/1970 | Babcock | 315/194 |
| 3,569,776 | 3/1971 | Moerkens et al. | 315/208 |
| 3,763,396 | 10/1973 | Shilling | 315/199 |
| 3,925,705 | 12/1975 | Elms et al. | 315/258 |
| 4,048,543 | 9/1977 | Owen et al. | 315/208 |
| 4,163,925 | 8/1979 | Gyursanszky | 315/DIG. 4 |
| 4,459,515 | 7/1984 | Smith | 315/194 |

*Primary Examiner*—Harold Dixon

*Attorney, Agent, or Firm*—Robert T. Mayer; Bernard Franzblau

[57] ABSTRACT

An adaptation circuit (3) for operating a high-pressure discharge lamp (1) via a controlled semiconductor switch (4) in series with the lamp. The control circuit for the switch (4) to comprise a voltage division circuit (5,6). The voltage division circuit is connected in parallel with the switch when the lamp is connected to the circuit output terminals (E,F) and one branch of the voltage division circuit comprises a parallel-combination of a capacitor (57) and a resistor (56). Thus, the variation of the voltage across the lamp influences the control of the semiconductor switch so that it is possible to stabilize, for the major part, the power dissipated by the lamp against, variation in the supply voltage and against lamp voltage variations during the life of the lamp.

17 Claims, 6 Drawing Figures

ADAPTION CIRCUIT FOR OPERATING A HIGH-PRESSURE DISCHARGE LAMP

BACKGROUND OF THE INVENTION

This invention relates to adaptation circuit for operating a high-pressure discharge lamp provided with a first and a second input terminal intended for connection to a supply source and with a first and a second output terminal intended for connection of a high-pressure discharge vessel of the high-pressure discharge lamp, each input terminal being connected to the respective output terminal, while the connection between the first input terminal and the first output terminal includes a first controlled semiconductor switch, of which a control electrode is connected to a junction between a first and a second branch of a voltage division circuit, which at least in the case of a connected lamp is arranged parallel to the first semiconductor switch. The invention further relates to a lamp provided with the adaptation circuit.

An adaptation circuit of the kind mentioned in the opening paragraph is known from U.S. Pat. No. 3,925,705. The known circuit permits the operation of a high-pressure discharge lamp in an apparatus provided with a stabilization ballast that is not adapted to the relevant lamp. Thus, besides a continuous improvement of the luminous efficacy of high-pressure discharge lamps, saving of energy can be attained on an existing apparatus while maintaining a desired illumination intensity.

Variations in the voltage of the supply source will lead, when using the known circuit, to variations in the control of the semiconductor switch and accordingly to variations in the lamp current and the lamp power. Variations in a voltage or a current are to be understood herein to mean variations in the value of the root of the time averaged square of the value of the relevant voltage or current, the so-called RMS value. In the case of power, variations are considered with respect to the value averaged in time.

High-pressure discharge lamps in many cases exhibit during their lifetime a variation in lamp voltage, lamp current and lamp power due to ageing processes in the lamp. Variations in lamp properties due to voltage source variations and due to lamp ageing may be disadvantageous on the one hand to the lamp because of increased lamp voltage and on the other hand for the adaptation circuit due to increased lamp current. An increased lamp voltage may lead to the lamp being extinguished because a higher reignition voltage is required at the increased lamp voltage, which may rise above the available supply source voltage. An increased lamp current will result in a larger current flowing through the semiconductor switch and thus leads to a higher dissipation in the semiconductor switch. More particularly, in the case of incorporation of the circuit, for example, in a lamp cap, this may give rise to problems.

SUMMARY OF THE INVENTION

An object of the invention is to provide a means by which variations in the voltage of the supply source and variations in lamp properties are compensated for at least in part. For this purpose, according to the invention, an adaptation circuit of the kind mentioned in the opening paragraph is characterized in that the first branch of the voltage division circuit comprises a voltage source dependent upon the lamp voltage, of which the voltage has the same polarity as the voltage across the voltage division circuit.

An advantage of the adaptation circuit according to the invention is that the voltage across the lamp influences the control of the first controlled semiconductor switch, as a result of which a more uniform lamp voltage is obtained. In an advantageous embodiment of the adaptation circuit, the voltage source depending upon the lamp voltage is composed of a parallel-combination of a capacitor and a resistor, this voltage source being connected to the second output terminal. During the time, in which the first semiconductor switch is opened (i.e. non-conducting), the capacitor fulfils the function of a voltage source, while for the time in which the switch is closed (i.e. conducting), the same capacitor is charged via the connection with the second output terminal to a voltage which is proportional to the lamp voltage. The parallel resistor inter alia serves to ensure that the voltage increase of the capacitor with an opened switch due to current through the voltage division circuit is neutralized in the next following period in which the first semiconductor switch is closed again. It has surprisingly been found that with this simple embodiment a satisfactory control of the first semiconductor switch can be obtained.

In the case of an adaptation circuit suitable for operation with a supply voltage having a periodically changing polarity, at least the parallel-combination is connected to direct voltage terminals of a rectifier bridge and the two alternating voltage terminals of this bridge are included in the voltage division circuit. Thus, it is achieved in a very simple manner that the voltage across the parallel-combination acting as a voltage source dependent upon the lamp voltage has the same polarity as the voltage across the voltage division circuit.

In order to guarantee the proportionality between the capacitor voltage and the lamp voltage, in an advantageous embodiment of the adaptation circuit the rectifier bridge is provided with a third alternating voltage terminal and the third alternating voltage terminal forms part of the connection between the voltage source depending upon the lamp voltage and the second output terminal. In this configuration, the parallel resistor of the voltage source dependent upon the lamp voltage at the same time serves to ensure that the proportionality between the capacitor voltage and the lamp voltage is maintained when the RMS value of the lamp voltage decreases.

Since the voltage at the second output terminal is only proportional to the lamp voltage if the first semiconductor switch is closed, in a further embodiment, the connection between the parallel-combination and the second output terminal includes a switch which is closed only when the first semi-conductor swithc is closed.

Preferably, the connection between the parallel-combination and the second output terminal includes a second resistor. This second resistor constitutes together with the resistor of the parallel combination the voltage division circuit which influences the ratio between the lamp voltage and the capacitor voltage.

The switch is preferably a second controlled semiconductor switch, of which an electrode is connected to the first output terminal. Thus, control of the second controlled semiconductor switch by means of the instantaneous lamp voltage is achieved in a simple and therefore favourable manner.

With the use of a supply source having a periodically changing polarity of the voltage and current of comparatively low frequency, such as a public supply mains, the controlled semiconductor switches are preferably constructed as triacs because these elements automatically become non-conducting upon a change of polarity of the current. In other cases, for example in the case of a supply by means of a direct voltage source, a separate circuit is required for rendering each of the semiconductor switches non-conducting.

BRIEF DESCRIPTION OF THE DRAWINGS

An example of an adaptation circuit according to the invention will now be described more fully with reference to the accompanying drawings, in which.

DESCRIPTION OF THE PREFERRED EMBODIMENTS

Figure 1:
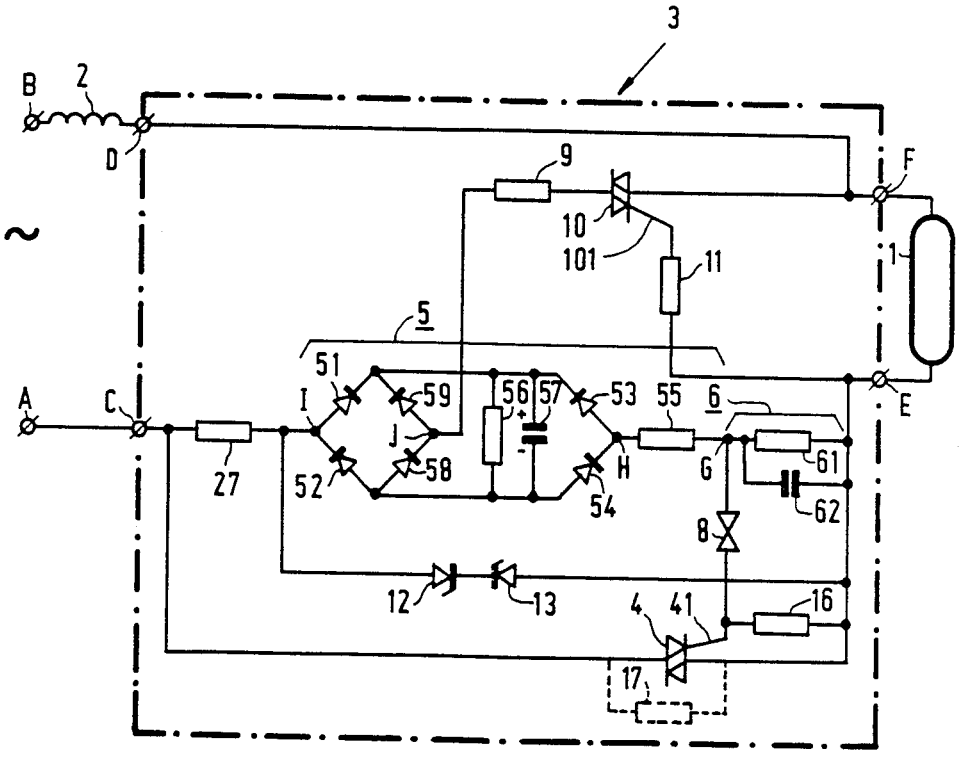
FIG. 1 shows an electric circuit diagram of the adaptation circuit with a connected high-pressure discharge lamp.

In FIG. 1, the connection terminals A and B of an alternating voltage supply source are connected to a first input terminal C and a second input terminal D, respectively, of an adaptation circuit 3. The connection between the connection terminal B and the input terminal D includes a stabilization ballast 2. The adaptation circuit is provided with a first output terminal E and a second output terminal F, to which a high-pressure discharge vessel 1 is connected. Each input terminal C, D is connected to the respective output terminal E,F. The connection between the first input terminal C and the first output terminal E includes a first controlled semiconductor switch consisting of a triac 4, of which a control electrode 41 is connected through a breakdown element in the form of a diac 8 to a junction G between a first branch 5 and a second branch 6 of a voltage division circuit. The first branch 5 is connected to the first input terminal C through a resistor 27. The second branch 6 comprises a parallel-combination of a resistor 61 and a capacitor 62 and is connected to the first output terminal E. The first branch 5 includes two alternating voltage terminals H and I of a rectifier bridge composed of diodes 51,52,53 and 54 in series with a resistor 55.

A parallel-combination of a resistor 56 and a capacitor 57 is connected to the direct voltage terminals of the rectifier bridge of the first branch 5 and functions as a voltage source dependent upon the lamp voltage. The rectifier bridge is provided via diodes 58,59 with a third alternating voltage terminal J, which forms part of the connection between the parallel-combination 56,57 and the second output terminal F. This connection includes a resistor 9 in series with a triac 10 acting as the second controlled semiconductor switch. A control electrode 101 of the triac 10 is connected via a resistor 11 to the first output terminal E. The branches 5 and 6 are shunted by a series-combination of two Zener diodes 12 and 13 having opposite polarities. The gate electrode 41 is connected through a resistor 16 to the output terminal E. The triac 4 may be shunted by a resistor 17.

The operation of the circuit in the case of an operating lamp is as follows.

In the case where the lamp is ignited, a lamp current $I_{1a}$ will flow in the circuit B,2,D,F,1,E,4,C,A. A voltage $V_{1a}$ is then applied across the discharge vessel 1, as a result of which the triac 10 is in the conductive state so that a current flows via the triac 10, the resistor 9 and the diode 59 to the parallel-combination of the resistor 56 and the capacitor 57 and subsequently via the parallel circuits constituted by the diode 52 and the resistor 27 on the one hand and by the diode 54, the resistor 55 and the resistor 61 on the other hand.

When the instantaneous voltage at the input terminals C,D falls to zero, the lamp current $I_{1a}$ and the lamp voltage $V_{1a}$ also fall to zero, as a result of which both the triac 4 and the triac 10 become non-conductive. As soon as the triac 4 has become non-conductive, substantially all of the instantaneous supply voltage will appear at the input terminals C,D. In fact the stabilization ballast 2 substantially does not take up any voltage because the current through the adaptation circuit increases only slightly due to the fact that the triacs 4 and 10 are non-conductive. A small current will flow through the resistor 27, the Zener diodes 12,13, the voltage division circuit and the resistor 17, if present. As soon as the instantaneous voltage at the junction G has reached the breakdown voltage of the diac 8, the diac 8 will break down and the capacitor 62 is abruptly discharged through the diac 8 and the control electrode 41, as a result of which the triac 4 becomes conducting and the lamp reignites so that a current will flow in the circuit C,4,E,1,F,D. The voltage difference then occurring between the output terminals E and F will also render the triac 10 conducting and a small current will flow in the circuit 58,9,10, as a result of which charge flows away from the capacitor 57. On the other hand, charge will flow to the capacitor 57 via both the circuit C,27,51 and the circuit C,4,61,55,53.

Subsequently, current and voltage at the input terminals C,D will decrease again and will change their polarities, the process described being repeated. The resistor 17 ensures that in the non-conductive state of the triac 4, a small current constantly flows through the lamp (the so-called "keep-alive current"), which ensures that ionization in the discharge vessel is maintained. This favours the limitation of the reignition voltage.

In order to ensure that the switch 10 certainly becomes conducting after reignition of the lamp, a further capacitor can be connected between the control electrode 101 and the second output terminal F.

The circuit comprising the Zener diodes 12 and 13 serves to ensure that the voltage division takes place between the branches 5 and 6 with respect to a voltage of constant value.

It appears from the above description of the operation of the adaptation circuit that a residual charge is present at the capacitor 57 at the end of a polarity phase of the lamp current $I_{1a}$. This residual charge and the associated voltage across the capacitor 57 influence the voltage division between the branches 5 and 6 and hence the instant of breakdown of the diac 8 in such a manner that a larger residual charge at the capacitor 57 with respect to a nominal value will cause the diac 8 to break down at a later instant, whereas a smaller residual charge at the capacitor 57 will accelerate the instant of breakdown of the diac 8.

For a constant RMS value of the lamp voltage $V_{1a}$, the residual charge at the capacitor 57 will have the same nominal value at the end of each polarity phase. However, of the RMS value of the lamp voltage $V_{1a}$ increases or decreases, this results in an increase or a decrease in the residual charge at the capacitor 57. As a result, the time duration in which the triac 4 is non-conducting increases or decreases. The result is that the power dissipated in the lamp decreases or increases, whereupon the temperature determining the vapour pressure in the discharge vessel decreases or increases so that the lamp voltage decreases or increases.

For further illustration, FIGS. 2*a* to *d* show the variation for a full period of the supply source frequency in order of succession of:

the lamp current $i_{1a}$ the supply voltage $V_n$ and the voltage $V_{CD}$ between the terminals C,D, the supply voltage $V_n$ and the lamp voltage $V_{1a}$ the voltage across the capacitor 57, $V_{57}$.

Figure 2:
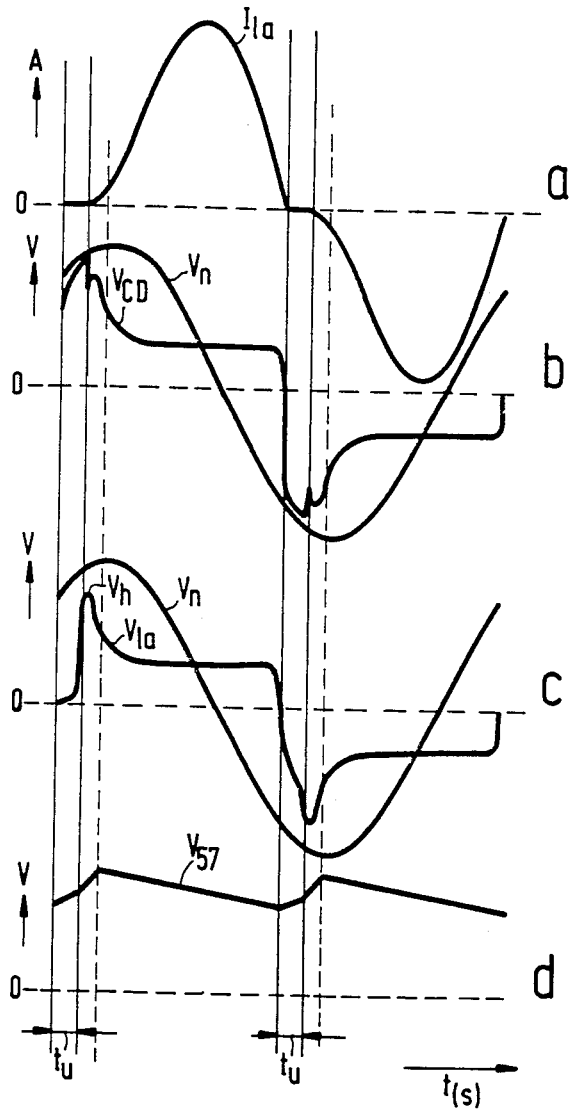
FIG. 2 is a graph showing the variation of the instantaneous currents and the instantaneous voltages in the case of operation of the circuit shown in FIG. 1.

In FIG. 2, the time duration for which the semiconductor switch 4 is non-conducting is indicated by $t_u$. In the case of the variation of the lamp voltage $V_{1a}$, the reignition voltage is indicated by $V_h$. As a result of the keep-alive current through the resistor 17, the lamp voltage $V_{1a}$ is unequal to zero for the time duration $t_u$ and slightly increases. At a comparatively small value of the resistor 17, the keep-alive current will be comparatively large so that the lamp voltage $V_{1a}$ will increase to a comparatively great extent for the period $t_u$.

Component values for a practical circuit will now be described. This circuit is connected to a supply source of 220 V, 50 Hz, by means of which a 400 W high-pressure sodium discharge lamp is operated. The filling of the lamp contained 25 mg of amalgam, 21% by weight of Na and 79% of mercury, and xenon at a pressure of 45 kPa at 300 K. The components of the circuit were proportioned as follows:

| | |
|---|---|
| Resistor 9 | 47 kΩ |
| Resistor 11 | 15 kΩ |
| Resistor 16 | 1 kΩ |
| Resistor 17 | 4.7 kΩ |
| Resistor 27 | 2.2 kΩ |
| Resistor 55 | 22 kΩ |
| Resistor 56 | 470 kΩ |
| Resistor 61 | 100 kΩ |
| Capacitor 57 | 0.22 μF |
| Capacitor 62 | 47 nF |
| Diodes 53,54 | Philips type BYV 96 E |
| Diodes 51,52,58,59 | General Instruments type WL 10 |
| Zener diodes 12,13 | Zener voltage 200 V, Philips type BZT 03 |
| Triac 4 | Philips type BT 138 |
| Triac 10 | Philips type BT 136 |
| Diac 8 | Breakdown voltage 32 V, Philips type BR 100. |

The adaptation circuit was connected via a stabilization ballast Philips type SON 400 W to the source of supply voltage.

Figure 3:
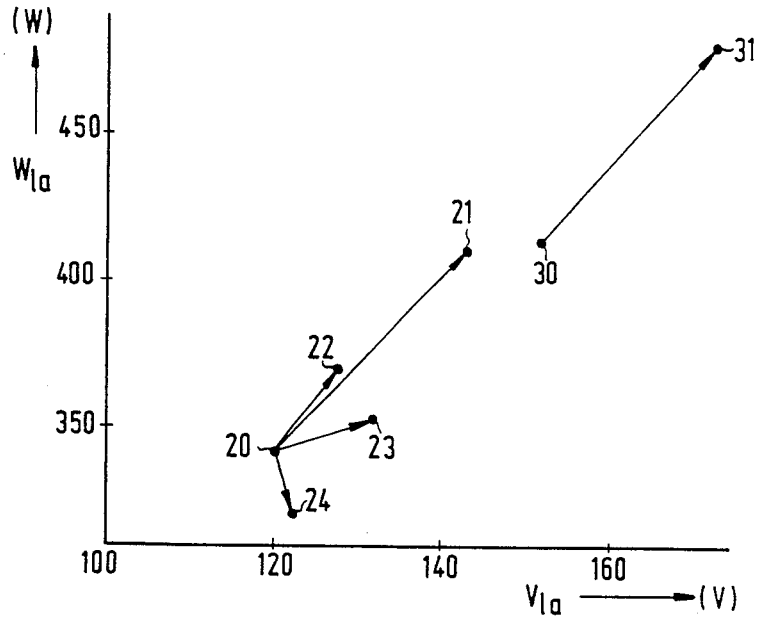
FIG. 3 shows a graphic representation of relations between lamp voltage and lamp power.

In FIG. 3, the RMS value of the lamp voltage $V_{1a}$ in V is plotted on the abscissa, while the average lamp power $W_{1a}$ in W is plotted on the ordinate. Reference numeral 20 denotes the working point of the practical lamp operated by means of the adaptation circuit as described above at a constant supply voltage of 220 V, 50 Hz, and a constant lamp voltage $V_{1a}$ of 120 V. The triac 4 is then non-conducting during each half period of the supply voltage frequency for 0.86 ms. Reference numeral 21 denotes the working point of the same lamp in the case where the value of the supply voltage has increased to 242 V, but with an adaptation circuit according to the prior art. The voltage division circuit is now shunted for control of the first semiconductor switch by a series-combination of two Zener diodes of opposite polarities. In the case of operation of the lamp in combination with the adaptation circuit according to the invention as described, the working point for a supply voltage of 242 V is denoted by reference numeral 22. The duration per half period in which the triac 4 is non-conducting amounts in this case to 1.12 ms. Reference numerals 23 and 24 denote the working points of the same lamp operated via the adaptation circuit according to the prior art and according to the invention, respectively, in case the supply voltage has a value of 220 V, 50 Hz, and the lamp voltage $V_{1a}$ is increased. The increase of the lamp voltage is produced by reflecting the heat radiation emitted by the lamp on the discharge vessel.

In the case of the adaptation circuit according to the prior art, the result is that the lamp voltage increases to 130 V and the average lamp power increases to 350 W. In the case of operation by the above embodiment of the adaptation circuit according to the invention, the average lamp power decreases to 320 W and the increase of the lamp voltage remains limited to about 2 V. The time duration for each half period of the supply voltage frequency in which the triac 4 is non-conducting is in this case 1.04 ms.

For further comparison, FIG. 3 indicates the working points of the same lamp when operated directly connected to a supply source without the use of an adaptation circuit The point 30 is the working point in the case where the supply voltage has a constant RMS value of 220 V, while the point 31 is the working point at a supply voltage value of 242 V.

Figure 4:
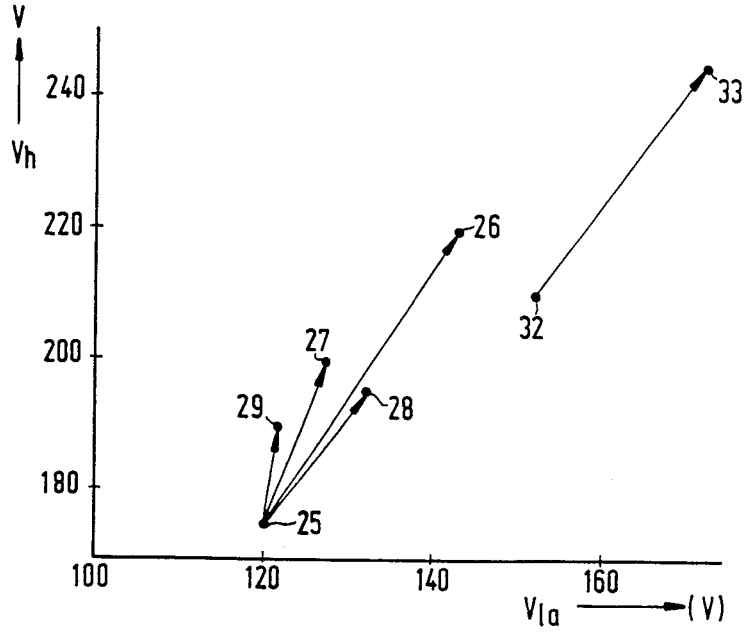
FIG. 4 shows a graphic representation of relations between lamp voltage and reignition voltage.

FIG. 4 indicates for each of the working points illustrated in FIG. 3 the value of the reignition voltage. The points in FIG. 4 relate to the working points illustrated in FIG. 3 as stated in the table below.

TABLE

| point in FIG. 4 | associated with working point in FIG. 3 |
|---|---|
| 25 | 20 |
| 26 | 21 |
| 27 | 22 |
| 28 | 23 |
| 29 | 24 |
| 32 | 30 |
| 33 | 31 |

Figure 5:
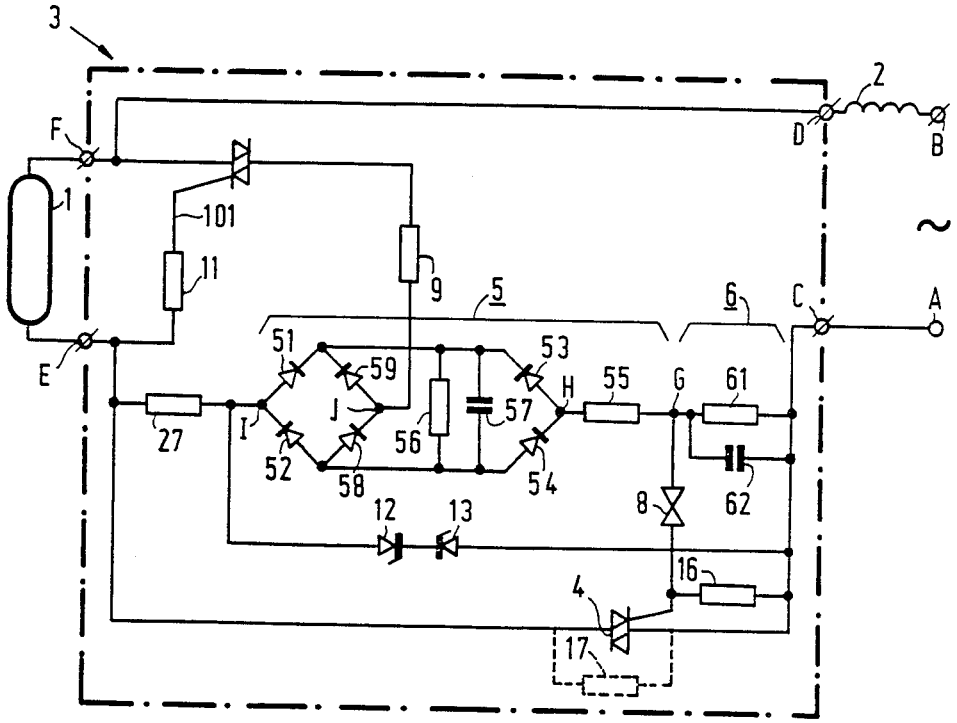
FIGS 5 and 6 show circuit diagrams of modifications of the adaptation circuits.
Figure 6:
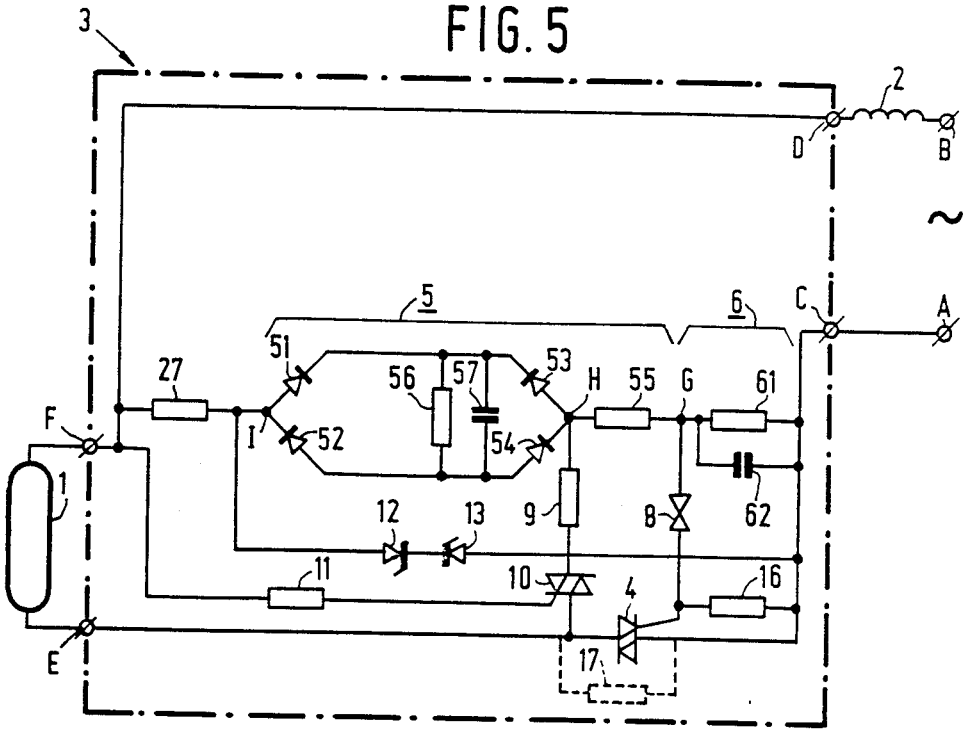

FIGS. 5 and 6 show modifications of the adaptation circuit. The elements corresponding to these of FIG. 1 are designated by the same reference numerals.

FIG. 5 shows the case in which, as compared with FIG. 1, the input terminals C,D and the output terminals E,F are exchanged with respect to the control electrode 41 of the triac 4.

In the circuit shown in FIG. 6, the output terminals E,F are displaced as compared with the circuit shown in FIG. 5 and are arranged between the first switch 4 and the resistor 27.

The voltage division circuit is thus connected in parallel both with the first switching element 4 and with the discharge vessel 1.

What is claimed is:

1. An adaptation circuit for operating a high-pressure discharge lamp comprising:

first and second input terminals for connection to a source of supply voltage via a series ballast impedance, first and second output terminals for connection to terminals of a discharge lamp connectable to said output terminals, means connecting a first controlled semiconductor switch between the first input terminal and the first output terminal, means connecting the second input terminal to the second output terminal, a voltage-division circuit coupled between said first input terminal and one of said output terminals so that the first semiconductor switch and the voltage-division circuit provide two parallel paths for current to flow between said first and second input terminals, wherein at least one of said current paths includes a discharge lamp when connected to said output terminals, said voltage division circuit having first and second branches with a junction point therebetween, said first branch including a capacitor, means including a voltage-responsive switch for connecting a control electrode of the first semiconductor switch to said junction point, and wherein the second branch of the voltage-division circuit includes a voltage source whose voltage is primarily determined by the lamp voltage and whose polarity is the same as that of a voltage developed across the voltage division circuit, whereby the firing angle of the first semiconductor switch varies with the lamp voltage in a sense to maintain lamp power constant despite variations in the supply voltage or variations in the lamp operating voltage.

2. A circuit as claimed in claim 1 wherein the voltage source in the second branch comprises a parallel combination of a second capacitor and a resistor.

3. A circuit as claimed in claim 2 wherein the second branch includes a rectifier bridge having a pair of output terminals connected to said parallel combination.

4. A circuit as claimed in claim 2 wherein the connection between the parallel-combination and the second output terminal includes a resistor.

5. A circuit as claimed in claim 4, wherein the connection between the parallel-combination and the second output terminal includes a switch which is closed only when the first semiconductor switch is closed.

6. A circuit as claimed in claim 5 wherein the switch comprises a second controlled semiconductor switch having a control electrode connected to the first output terminal.

7. A circuit as claimed in claim 2 further comprising means connecting the parallel combination to the second output terminal via a switch which is closed only when the first semiconductor switch is closed.

8. A circuit as claimed in claim 7 wherein the switch comprises a second controlled semiconductor switch having a control electrode connected to the first output terminal.

9. A circuit as claimed in claim 1 for operation with a periodic supply voltage having changing polarities, wherein the voltage source in the second branch comprises a parallel combination of a second capacitor and an impedance device and at least the parallel combination is connected to direct voltage terminals of a rectifier bridge with two alternating voltage terminals of the bridge included in the second branch of the voltage division circuit.

10. A circuit as claimed in claim 1, wherein the source of supply voltage is an AC voltage and said first semiconductor switch is conductive for a portion of each half cycle of the AC voltage, said voltage source in the second branch maintaining a significant voltage level during the conductive portion of the first semiconductor switch in each said half cycle of the AC voltage.

11. A circuit as claimed in claim 1, wherein the voltage source in the second branch includes a second capacitor, said circuit further comprising a second controlled semiconductor switch coupling and second capacitor to the other one of said output terminals, and means coupling a control electrode of the second semiconductor switch to the one of said output terminals so that the voltage at the output terminals control the switching-on of the second semiconductor switch.

12. A circuit as claimed in claim 1, wherein the voltage-division circuit is coupled between the first input terminal and the second output terminal so that, during the time when the first semiconductor switch is conductive and a connected discharge lamp is in its operating state, said voltage division circuit is in parallel with a series combination of the first semiconductor switch and the connected discharge lamp.

13. A circuit as claimed in claim 1, wherein the voltage source in the second branch includes a second capacitor, said circuit further comprising a second semiconductor switch coupling said second capacitor to one of said output terminals and one of said input terminals, said second semiconductor switch being controlled by a voltage across said output terminals so as to provide a charge path for the second capacitor when a connected lamp is in its operating state.

14. A circuit as claimed in claim 1, wherein the voltage source in the second branch includes a second capacitor, said circuit further comprising a second semiconductor switch controlled by a voltage at said output terminals to provide a charge path for the second capacitor that excludes the lamp when the lamp is connected to said output terminals.

15. A circuit as claimed in claim 14, wherein the second branch further comprises a rectifier bridge having one input terminal coupled to one of said first and second input terminals of the adaptation circuit and another input terminal coupled to the other one of said first and second input terminals of the adaptation circuit via the second semiconductor switch, and output terminals coupled to the second capacitor.

16. A circuit as claimed in claim 14, further comprising an impedance device coupled to the second capacitor to provide a discharge path for the second capacitor.

17. A circuit as claimed in claim 1, wherein the voltage source in the second branch includes a second capacitor and an impedance device coupled to the second capacitor to provide a discharge path therefor, said circuit further comprising a second semiconductor switch coupled to the second capacitor to provide a charge path therefor and controlled by a voltage at said circuit output terminals so that the first and second semiconductor switches are turned on and off in synchronism.

* * * * *